US005782677A

United States Patent [19]

Kanouse

[11] Patent Number: 5,782,677

[45] Date of Patent: Jul. 21, 1998

[54] CONTINUOUS PROCESS BLAST MILL FOR FINISHING CAST METAL PARTS

[76] Inventor: Richard C. Kanouse, S38 W34402 Hwy. D, Dousman, Wis. 53118

[21] Appl. No.: 783,129

[22] Filed: Jan. 14, 1997

[51] Int. Cl.[6] ..... B24B 31/023; B24C 3/08; B24C 3/78

[52] U.S. Cl. ..... 451/85; 451/82; 451/87; 451/89; 451/103; 451/328; 241/182; 241/183

[58] Field of Search ..... 220/400; 241/176, 241/177, 178, 179, 182, 183; 451/66, 85, 82, 87, 89, 103, 113, 328

[56] References Cited

U.S. PATENT DOCUMENTS

| | | | |
|---|---|---|---|
| Re. 29,220 | 5/1977 | Rampe . | |
| 1,591,703 | 7/1926 | Greenfield | 241/178 |
| 1,679,378 | 8/1928 | Sanders | 451/85 |
| 1,710,166 | 4/1929 | Hull | 451/85 |
| 1,710,612 | 4/1929 | Fatscher et al. | 451/85 |
| 1,715,711 | 6/1929 | Kosian | 451/85 |
| 1,770,013 | 7/1930 | Rich, Jr. | 451/85 |
| 2,154,883 | 4/1939 | Zahn . | |
| 2,422,786 | 6/1947 | Keefer . | |
| 2,424,955 | 7/1947 | Potter . | |
| 2,440,819 | 5/1948 | Evans . | |
| 2,565,385 | 8/1951 | Lupo | 451/328 |
| 2,984,948 | 5/1961 | Bixby | 451/85 |
| 3,585,758 | 6/1971 | Harper . | |
| 3,693,296 | 9/1972 | Carpenter, Jr. . | |
| 3,821,866 | 7/1974 | Carpenter . | |
| 3,883,997 | 5/1975 | Burlingame . | |
| 4,003,164 | 1/1977 | Carpenter, Jr. et al. . | |
| 4,254,592 | 3/1981 | Berna et al. . | |
| 4,277,918 | 7/1981 | Bass . | |
| 4,333,276 | 6/1982 | Goff . | |
| 4,476,655 | 10/1984 | Ansbaugh . | |
| 4,577,441 | 3/1986 | Brenner . | |
| 4,648,214 | 3/1987 | Brull et al. . | |
| 4,881,385 | 11/1989 | Lambrechts . | |
| 5,163,253 | 11/1992 | Carpenter, Jr. | 451/82 X |
| 5,417,608 | 5/1995 | Elliott | 451/96 X |
| 5,461,763 | 10/1995 | Donnelly | 29/81.08 |
| 5,512,008 | 4/1996 | Musschoot | 451/85 |

FOREIGN PATENT DOCUMENTS

| | | | |
|---|---|---|---|
| 664971 | 9/1938 | Germany | 451/85 |
| 56-152581 | 11/1981 | Japan | 451/85 |

*Primary Examiner*—Timothy V. Eley
*Attorney, Agent, or Firm*—John L. Rogitz

[57] ABSTRACT

A workpiece cleaning mill that is useful for cleaning castings includes a hollow housing that is established by arranging plural elongated manganese flights side-by-side to establish a cylinder, and attaching the flights to opposed entrance and exit rings. A feed conveyor feeds workpieces into the entrance end, and an exit conveyor conveys the workpieces away from the exit end. Media throwers are disposed at each end to throw high-speed cleansing media, such as shot, into the housing. The housing is rotated as the workpieces move, under the influence of gravity and/or following workpieces being fed into the housing, from the entrance end to the exit end while being bombarded with shot. Steel mesh curtains at each end block the media from passing outside of the mill. Spent media falls through perforations in the flights, and the spent media is conveyed back to a media hopper and thence to the media throwers for reuse. Magnetic valves regulate the amount of media thrown by the throwers.

16 Claims, 3 Drawing Sheets

CONTINUOUS PROCESS BLAST MILL FOR FINISHING CAST METAL PARTS

FIELD OF THE INVENTION

The present invention generally relates to cleaning manufactured workpieces, and more particularly to methods and apparatus for cleaning castings by abrasion.

BACKGROUND

Cast metal parts (referred to in the art as "castings" and, more generally, "workpieces") are cleaned after they are cast by subjecting the castings to abrasion. The abrasive cleaning might be undertaken in more than one step, with much of the cleaning being accomplished by directing high speed shot against the castings. To ensure that the castings are completely cleaned, the castings ordinarily are tumbled in an enclosure referred to as a "tumbling mill" while being bombarded by high speed steel shot that is directed into the tumbling mill.

It will readily be appreciated that the tumbling mill must be made of material that is harder than the steel shot, so that the tumbling mill can withstand the cleaning process. Accordingly, existing tumbling mills are constructed by arranging a plurality of elongated hardened slats, referred to as "flights", side-by side in a conveyor belt configuration inside of a housing. The flights, which are made of manganese or some other hard metal, are joined by links, and together the flights and links establish a conveyor belt that is driven by means of sprockets and rollers to move in an endless chain, thereby tumbling castings which have been disposed in the tumbling mill. As the castings are tumbled, they are blasted with shot to clean the castings. U.S. Pat. No. 4,476,655 is representative of such apparatus.

Unfortunately, it happens that many existing tumbling mills suffer several drawbacks. For example, many tumbling mills, such as the one disclosed in the above-referenced patent, are batch apparatus, meaning that the castings must be loaded into the tumbling mills, cleaned, and then unloaded after cleaning. This is labor intensive, and it wastes processing time, because as the castings are being loaded and unloaded, the tumbling mill must be shut down. Furthermore, not only must the flights be made of relatively expensive manganese, but so must the links and the links connectors, because they are exposed to the shot. Moreover, much maintenance is required on the tumbling mill's internal parts, such as sprockets, traction wheels, links, and pins. Still further, castings in many previous tumbling mills can become undesirably attached to or otherwise stick to the conveyor that is established by the flights.

As recognized by the present invention, however, it is possible to provide a tumbling mill which cleans castings in a continuous process, which is simple in construction, and which does not require any components other than the inner surface of the flights to be made of manganese. Moreover, with this understanding the present invention provides a superior apparatus with improved material wear characteristics and enhanced workpiece agitation characteristics vis-a-vis simple rotating flightless barrel apparatus such as the one disclosed in U.S. Pat. No. 4,277,918. Accordingly, it is an object of the present invention to provide an apparatus for cleaning castings that uses a continuous cleaning process. Another object of the present invention is to provide an apparatus for cleaning castings that has a comparatively simple construction. Still another object of the present invention is to provide an apparatus for cleaning castings that requires only the inside surfaces of flights to be made of relatively hard material. Yet another object of the present invention is to provide an apparatus for cleaning castings that is easy to use and cost-effective.

SUMMARY OF THE INVENTION

A continuous operation apparatus is disclosed for cleaning workpieces, such as castings. The apparatus includes a plurality of elongated flights that are arranged generally side-by-side to establish a blast housing. The blast housing defines opposed entry and exit ends and an inner surface and an outer surface. At least one drive roller is rollably engaged with the outer surface of the blast housing for causing the blast housing to rotate. Also, at least one support roller is rollably engaged with the outer surface of the blast housing to support the housing. Moreover, at least one entrance media thrower is juxtaposed with the entrance end, and the entrance media thrower is oriented to direct cleansing media into the blast housing. Likewise, at least one exit media thrower is juxtaposed with the exit end and is oriented to direct cleansing media into the blast housing. At least one entrance curtain is juxtaposed with the entrance end to block media from propagating past the entrance curtain, and at least one exit curtain is juxtaposed with the exit end to block media from propagating past the exit curtain.

In a preferred embodiment, an entrance conveyor is positioned for conveying workpieces into the entrance end of the housing. Similarly, an exit conveyor is positioned for conveying workpieces away from the exit end, and workpieces are pushed from the entrance end to the exit end by other workpieces. To further promote passage of workpieces through the housing, a tilt mechanism is disposed beneath the blast housing for tilting the blast housing, whereby workpieces are urged from the entrance end of the housing to the exit end by gravity.

Preferably, the apparatus still further includes an entrance ring, an exit ring, and a plurality of fasteners, and the flights extend between the rings with the outer surface of each flight being held against the rings by the fasteners. As disclosed further below, each fastener extends from the outward surface of a flight into which it has been welded into a respective ring, such that the fasteners and rings are shielded from the cleansing media by the flights.

Desirably, an entrance vestibule is juxtaposed with the entrance end and an exit vestibule is juxtaposed with the exit end. The entrance and exit curtains are respectively suspended in the entrance and exit vestibules. At least one of the vestibules can be distanced from the blast housing to permit a person to enter the blast housing.

To permit reclaiming cleansing media, at least some of the flights are perforated along respective exit segments to permit cleansing media to pass therethrough to a spent media chamber. The flights, however, are not perforated along respective entrance segments, to thereby promote mixing of the media and the workpieces. A media conveyor conveys media from the spent media chamber to a media hopper. Then, a feed conveyor feeds media from the hopper to the thrower. A respective magnetic control valve is in communication with each thrower for regulating media input thereto.

In another aspect, a tumbling mill for cleaning workpieces includes a rotatable housing including plural elongated manganese flights that define respective entrance ends and exit ends. The entrance ends are attached to an inner surface of an entrance ring, whereas the exit ends are attached to an inner surface of an exit ring. Steel curtains are arranged to block high speed cleansing media in the housing from propagating out of the mill.

In still another aspect, a method is disclosed for cleaning workpieces which includes providing a housing having open entrance and exit ends. The method also includes conveying workpieces to the entrance end, rotating the housing, and directing high speed cleansing media into the housing from both ends. Media that propagates past the open ends is blocked.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
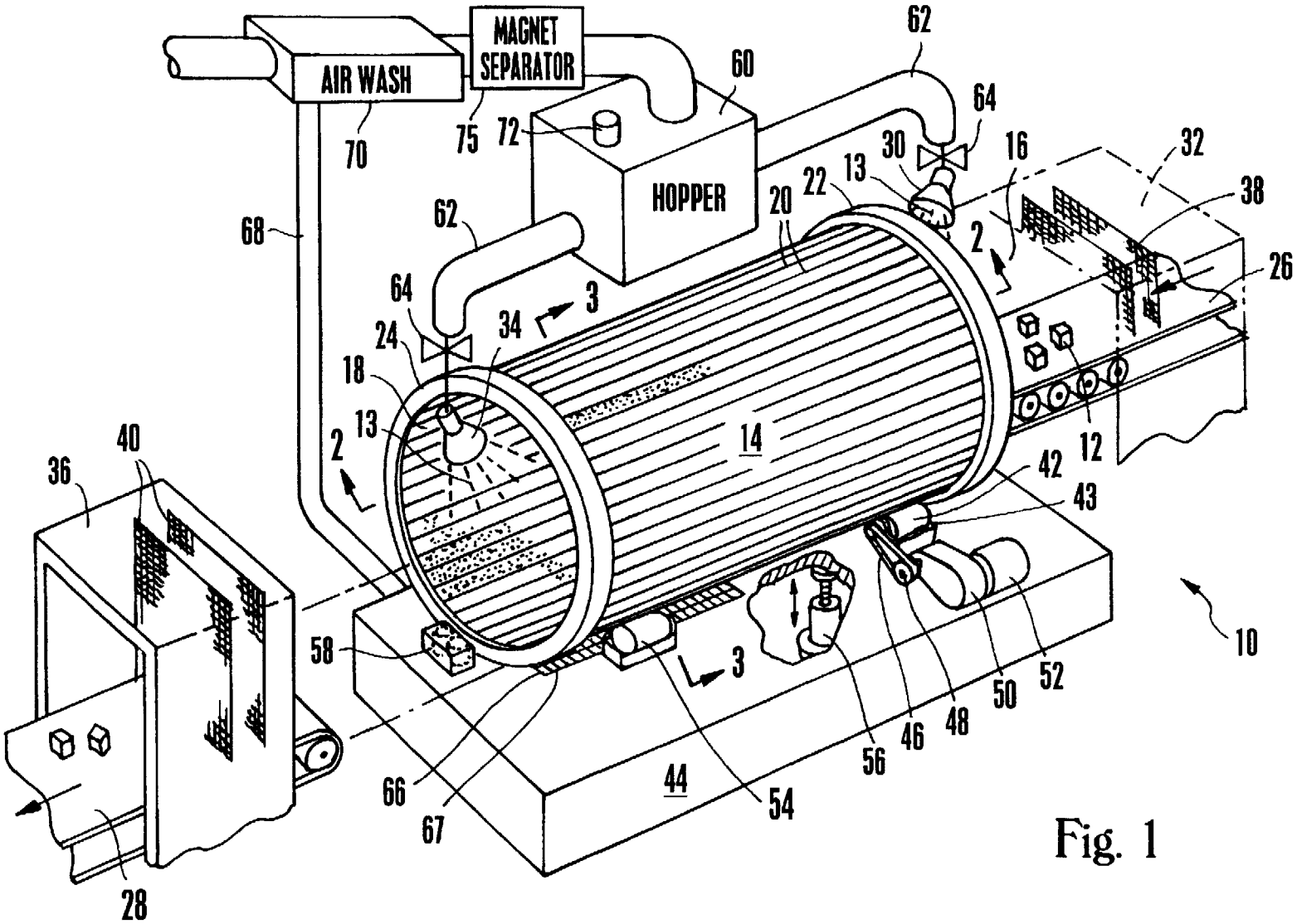
FIG. 1 is a perspective view of the tumbling blast mill of the present invention, with portions shown schematically, with the vestibules shown in phantom in an exploded relationship, and with portions of the base broken away for clarity.

Referring initially to FIG. 1, a blast mill is shown, generally designated 10, for cleaning workpieces 12. In the preferred embodiment, the workpieces 12 are castings; accordingly, the blast mill 10 cleans the workpieces 12 by bombarding the workpieces 12 with cleansing media 13 composed of high speed steel shot. It is to be understood, however, that the principles of the present invention can be applied to workpieces other than castings, and that the composition of the cleansing media is established as appropriate for the particular workpieces that are to be cleaned.

As shown in FIG. 1, the mill 10 includes a hollow cylindrical housing 14 defining an open entrance end 16 and an open exit end 18. In the preferred embodiment, the housing 14 is established by a plurality of elongated, parallelepiped-shaped flights 20 that are arranged generally side-by-side as shown to establish the housing 14. Preferably, each flight 20 is fourteen feet (14') long and is made of an alloy of which 11%–14% is manganese.

FIG. 1 shows that the flights 20 are held in the cylindrical arrangement shown by opposed steel entrance and exit rings 22, 24, with the rings 22, 24 defining the ends 16, 18 of the housing 14. As more fully disclosed below, the flights 20 are attached at their ends to the respective inner surfaces of the rings 22, 24 by means of steel fasteners. With this combination of structure, the flights 20 extend between the rings 22, 24 with the outer surface of each flight 20 being held against the inner surface of the rings 22, 24 by the fasteners. Consequently, the fasteners and rings are shielded from the cleansing media by the flights 20.

With the above disclosure in mind, the workpieces 12 are conveyed into the entrance end 16 of the housing 14 by an entrance conveyor 26. Also, an exit conveyor 28 is positioned for conveying workpieces 12 away from the exit end 18 of the housing 14. In accordance with the present invention, workpieces 12 are pushed from the entrance end 16 to the exit end 18 by other workpieces 12, as the other workpieces 12 are conveyed into the housing 14. As the workpieces 12 travel through the housing 14, the workpieces 12 are bombarded by the cleansing media 13, and the housing 14 is rotated to tumble the workpieces 12 to thereby promote complete cleaning of the workpieces 12 by the media 13.

Turning first to the cleansing media 13 bombardment, two entrance media throwers 30 (only one entrance thrower 30 shown schematically in FIG. 1 for clarity) are juxtaposed with the entrance end 16 of the housing 14. As shown, the entrance media throwers 30 are oriented to direct cleansing media 13 into the housing 14. Preferably, a hollow entrance vestibule 32 is engaged with the housing 14, and the entrance media throwers 30 are mounted on the entrance vestibule 32.

Similarly, two exit media throwers 34 (only one exit thrower 34 shown schematically in FIG. 1 for clarity) are juxtaposed with the exit end 18 of the housing 14. As shown, the exit media throwers 34 are oriented to direct cleansing media 13 into the housing 14. As recognized by the present invention, by directing cleansing media 13 into the housing 14 from both ends 16, 18 thereof, uniform disposition of the media 13 within the housing 14 is promoted. In the presently preferred embodiment, the media throwers 30, 34 are Bronco sixty horsepower sixteen inch media wheels made by RCK Industries, Inc. of Dousman, Wis.

Preferably, a hollow exit vestibule 36 is engaged with the housing 14, and the exit media throwers 34 are mounted on the exit vestibule 36 (FIG. 1 shows the exit vestibule 36 in an exploded relationship with the exit media thrower 34 and the housing 14). If desired, as indicated in FIG. 1 the exit vestibule can be pivoted away from or translationally moved away from the housing 14 to permit a person to enter the housing 14.

Advantageously, a plurality of, preferably four (4), steel mesh entrance curtains 38 are suspended within the entrance vestibule 32 and accordingly are juxtaposed with the entrance end 16 of the housing 14 to block media 13 from propagating past the entrance curtains 38. Likewise, a plurality of, preferably four (4), steel mesh exit curtains 40 hang within the exit vestibule 36 and accordingly are juxtaposed with the exit end 18 of the housing 14 to block media 13 from propagating past the exit curtains 40. The workpieces 12, however, can pass through the curtains 38, 40.

Now addressing the means by which the housing 14 is rotated, a plurality of, preferably three (3), polyurethane drive rollers 42 (only one drive roller 42 shown in FIG. 1 for clarity) are rollably engaged with the outer surface of the housing 14 as shown. The drive rollers 42 are rotatably mounted in respective channels 43 (best shown in FIG. 2) that are formed on a hollow base 44, and when the drive rollers turn, the housing 14 rotates in response.

To turn the drive rollers 42, respective drive motors are coupled to the drive rollers 42. Specifically, as shown in FIG. 1 an axle of each drive roller 42 is coupled via a chain drive 46 with an associated sprocket 48. In turn, the sprocket 48 is coupled to a gear assembly 50. If desired, the sprocket 48 can be coupled to the gear assembly 50 via a second sprocket (not shown). Power from a motor 52 is transferred through the train discussed above to the drive roller 42 to turn the drive roller 42 and thereby cause the housing 14 to rotate. In the presently preferred embodiment, the motor 52 is a ten horsepower (10 HP) twelve hundred revolutions per minute (1200 RPM) "C" faced variable speed electric motor, and the gear assembly 50 is a CONE double reduction right angle gear assembly with a one hundred fifty to one (150:1) reduction ratio and a double enveloping tooth design. It is to be understood that the speed of the motor 52 is established as appropriate for the desired speed of rotation of the housing 14, the speed being dependent on the particular characteristics and requirements of the workpieces 12.

In addition to the drive rollers 42, a plurality of support rollers 54 are rollably engaged with the housing 14. Accordingly, the housing 14 is rotated by the drive rollers 42 and supported by the support rollers 54.

As mentioned above, workpieces 12 are pushed through the housing 14 by following workpieces 12. Additionally, to promote passage of the workpieces 12 through the housing 14, the entrance end 16 of the housing 14 can be tilted above the exit end 18. To undertake such tilting, at least one and preferably two screw jacks 56 are positioned beneath the base 44 near the entrance end 16 to raise the entrance end 16 above the exit end 18 and thereby promote passage of the workpieces 12 through the housing 14. To prevent slippage of the housing 14 on the base 44, a cam follower 58 that is welded on the base 44 abuts the exit ring 24.

The present invention also envisions control of the rate of cleansing media 13 introduction into the housing 14. More particularly, the media throwers 30, 34 are fed media 13 from a media hopper 60 via type "AR" helicoid conveyors 62, and respective control valves 64 are disposed in the inlets to the media throwers 30, 34 to regulate the amount of media 13 that is input to the throwers 30, 34. Preferably, the control valves 64 are magnetic valves that have no moving parts and, hence, that are low maintenance. In the preferred embodiment, the control valves 64 are magnetic control valves made by Jack Champlain of Mishiwak, Ind. The valves 64 can be adjusted as desired to establish a predetermined media 13 throughput to the throwers 30, 34.

Figure 2:
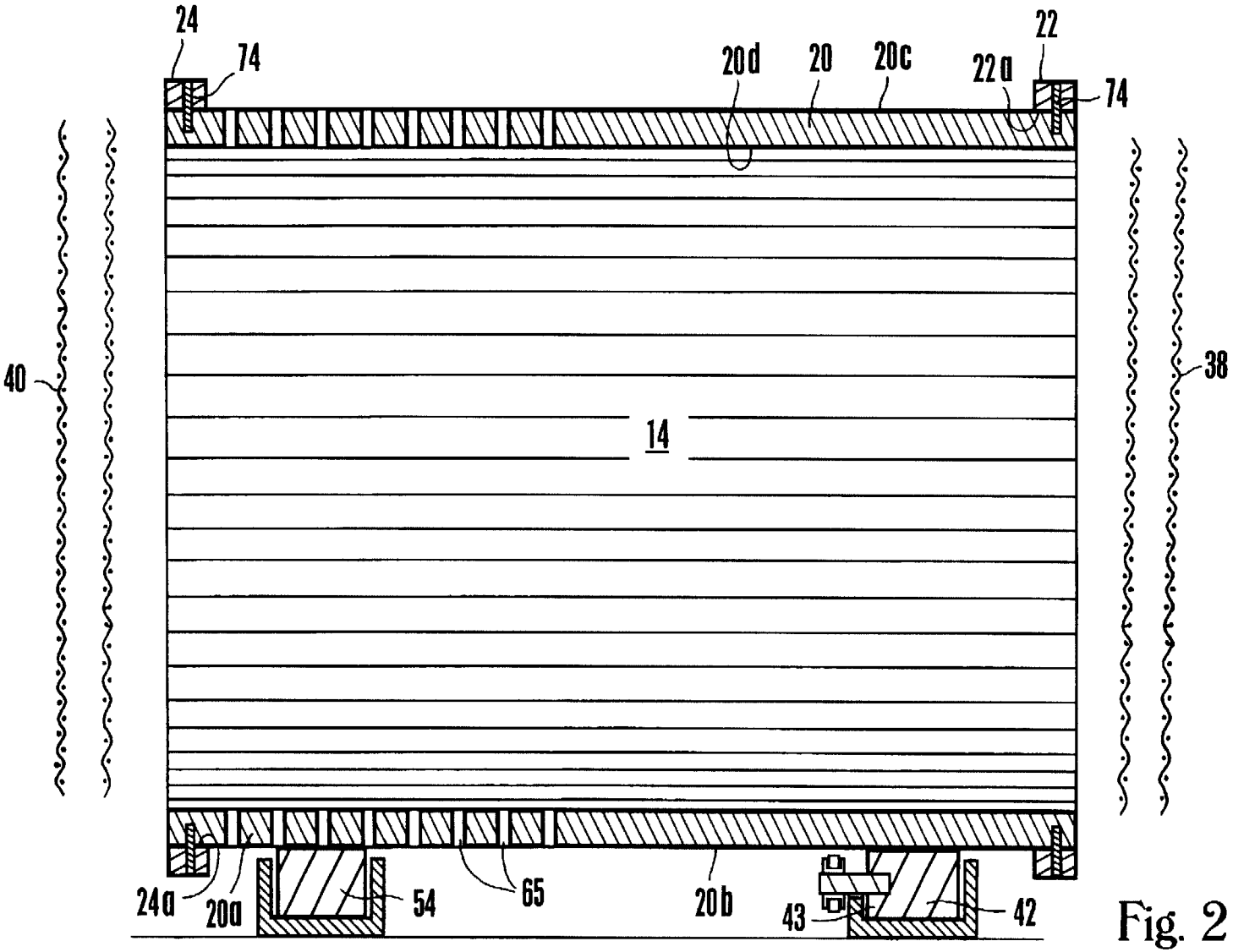
FIG. 2 is a cross sectional view as seen along the line 2—2 in FIG. 1.

In addition to controlling the rate of media 13 introduction to the housing 14, the present invention contemplates recycling spent media 13. In understanding the recycling process, reference is made to FIGS. 1 and 2. As shown in FIG. 2, each flight 20 is formed with perforations 65 along a respective exit segment 20A, and the housing 14 includes a perforated grate 67 (FIG. 1) under the exit segments 20A, to permit cleansing media 13 to pass therethrough to a spent media chamber 66 (FIG. 1). In contrast, the flights 20 are not perforated along respective entrance segments 20B, thereby promoting mixing of the media 13 and the workpieces 12.

Accordingly, media 13 falls through the perforations 65 into the spent media chamber 66. The media 13 is then conveyed via a sixteen inch (16") type "AR" helicoid and screw trough conveyor 68 to an air wash device 70 (FIG. 1). Per principles of the present invention, the air wash device 70 is any device known in the art that is appropriate for separating sand from the media 13. From the air wash device 70, the media passes through a magnetic rotating drum 71 to further separate the media 13 from debris, and then the media 13 is conveyed to the hopper 60. If desired, a magnetic sensor 72 senses the level of media 13 in the hopper 60 and generates a signal to stop the conveyor 68 when the level of media 13 in the hopper 60 reaches a predetermined level.

Figure 3:
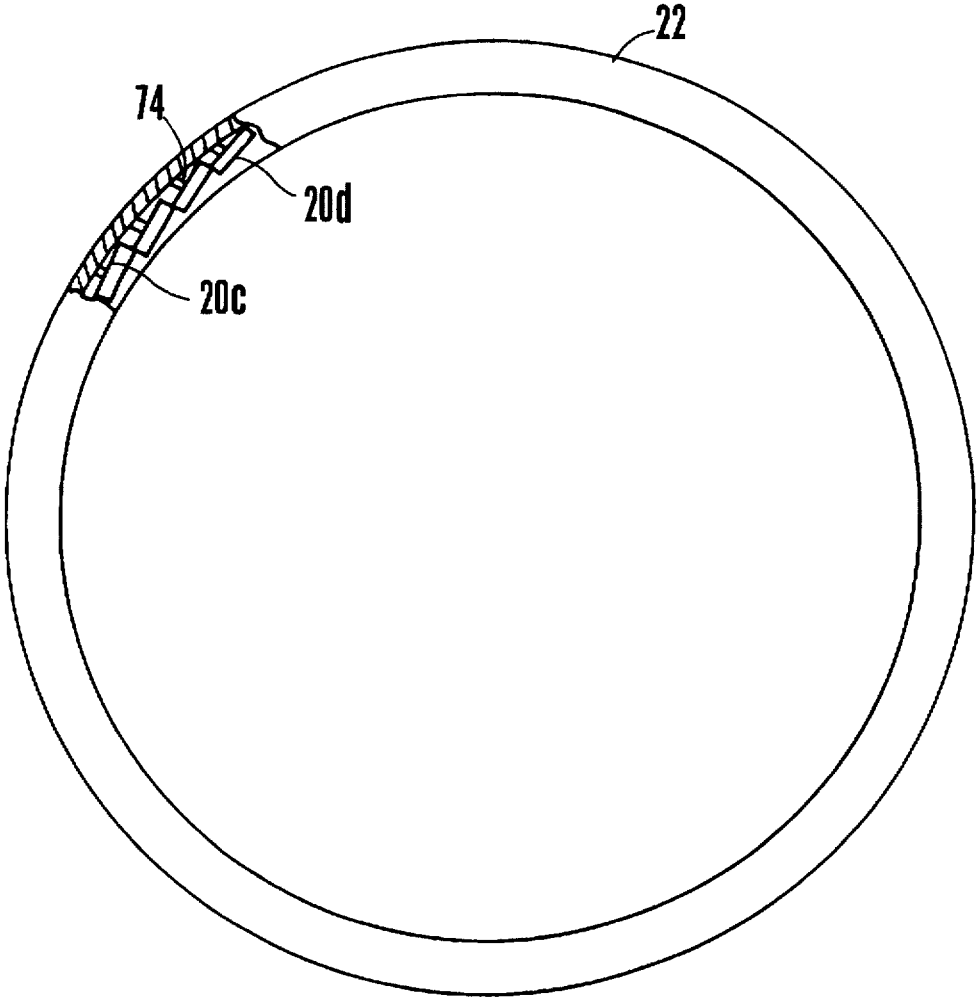
FIG. 3 is a cross-sectional view as seen along the line 3—3 in FIG. 1.

Additional details of the preferred flight 20 cooperation of structure can be appreciated in cross-reference to FIGS. 2 and 3. Post-like metal fasteners 74 are disposed into holes that are formed into the radially outer surfaces 20C of the flights 20, and the fasteners 74 are then welded into their respective flights 20. The fasteners 74 do not extend past the radially inside surfaces 20D of the flights 20. I have found that disposing the fasteners into holes in the flights and then welding them in place reduces the risk that the fasteners might break off from their respective flight.

As shown, each fastener 74 protrudes outwardly toward one of the entrance and exit rings 22, 24, with which the fastener is engaged. In other words, the outer surfaces 20C of the flights 20 are juxtaposed with the radially inward surfaces 22A, 24A of the rings 22, 24. Consequently, the fasteners 74 advantageously are not exposed to the media 13, nor are the rings 22, 24 exposed to the media 13.

Figure 4:
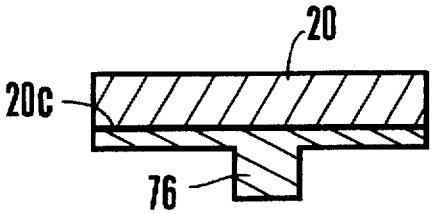
FIG. 4 is a cross-sectional view of an alternate flight having a steel backing bar.

Further, as shown in FIG. 3, the flights 20 are generally positioned side-to-side, but are not flushly positioned side-to-side. Instead, to promote agitation of the workpieces 12, the flights 20 overlap each other as shown. If desired, as shown in FIG. 4 the outer surface 20C (relative to the orientation of the flights 20 when combined into the housing 14) of each flight 20 can be welded to a steel strength member 76 which is oriented perpendicularly to the flight 20. Accordingly, the flight 20 with strength member 76 establishes a "T"-shaped transverse cross-section.

While the particular CONTINUOUS PROCESS BLAST MILL FOR FINISHING CAST METAL PARTS as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. An apparatus for cleaning workpieces, comprising:

a plurality of elongated flights arranged to establish a blast housing defining opposed entry and exit ends, the blast housing defining an inner surface and an outer surface;

at least one drive roller rollably engaged with the outer surface of the blast housing for causing the blast housing to rotate;

at least one support roller rollably engaged with the outer surface of the blast housing;

at least one entrance media thrower juxtaposed with the entrance end and oriented to direct cleansing media into the blast housing;

at least one exit media thrower juxtaposed with the exit end and oriented to direct cleansing media into the blast housing;

at least one entrance curtain juxtaposed with the entrance end to block media from propagating past the entrance curtain;

at least one exit curtain juxtaposed with the exit end to block media from propagating past the exit curtain; and an entrance vestibule juxtaposed with the entrance end and an exit vestibule juxtaposed with the exit end, wherein the entrance and exit curtains are respectively suspended in the entrance and exit vestibules, and wherein at least one of the vestibules can be distanced from the blast housing to permit a person to enter the blast housing.

2. The apparatus of claim 1, further comprising:

an entrance conveyor positioned for conveying workpieces into the entrance end; and an exit conveyor positioned for conveying workpieces away from the exit end, wherein workpieces are pushed from the entrance end to the exit end by other workpieces.

3. The apparatus of claim 2, further comprising a tilt mechanism disposed beneath the blast housing for tilting the blast housing, whereby workpieces are urged from the entrance end to the exit end by gravity.

4. The apparatus of claim 1, wherein the entrance curtain and exit curtain are made of metal mesh.

5. The apparatus of claim 4, further comprising plural entrance curtains and plural exit curtains.

6. The apparatus of claim 1, further comprising a support bar welded to each flight to support the flight.

7. The apparatus of claim 6, further comprising:

an entrance ring;

an exit ring; and a plurality of fasteners, wherein the flights extend between the rings with the outer surface of each flight relative to the housing being held against the rings by the fasteners, each fastener extending from within a respective flight outwardly to a respective ring, such that the fasteners and rings are shielded from the cleansing media by the flights.

8. The apparatus of claim 1, wherein at least some of the flights are perforated along respective exit segments of the flights to permit cleansing media to pass therethrough to a spent media chamber, the flights not being perforated along respective entrance segments of the flights to promote mixing of the media and the workpieces.

9. The apparatus of claim 8, further comprising:

at least one media hopper;

a spent media chamber:

a media conveyor for conveying media from the spent media chamber to the media hopper; and a feed conveyor for feeding media from the hopper to at least one of the throwers.

10. The apparatus of claim 9, further comprising at least one magnetic control valve in communication with the thrower for regulating media input thereto.

11. A tumbling mill for cleaning workpieces, comprising:

a rotatable housing comprised of plural elongated flights defining respective entrance ends and exit ends, the entrance ends being attached to an inner surface of an entrance ring, the exit ends being attached to an inner surface of an exit ring; and steel curtains arranged to block high speed cleansing media in the housing from propagating out of the mill from the rings, wherein at least some of the flights are perforated along respective exit segments to permit cleansing media to pass therethrough to a spent media chamber, the flights not being perforated along respective entrance segments to promote mixing of the media and the workpieces.

12. The mill of claim 11, further comprising:

at least one drive roller rollably engaged with the housing for causing the blast housing to rotate;

at least one support roller rollably engaged with the housing;

at least one entrance media thrower juxtaposed with the entrance ring and oriented to direct cleansing media into the housing; and at least one exit media thrower juxtaposed with the exit ring and oriented to direct cleansing media into the housing.

13. The mill of claim 12, further comprising:

an entrance conveyor positioned for conveying workpieces toward the entrance ring;

an exit conveyor positioned for conveying workpieces away from the exit ring, wherein workpieces are pushed from the entrance ring to the exit ring by other workpieces; and a tilt mechanism disposed beneath the housing for tilting the housing, whereby workpieces are urged from the entrance ring toward the exit ring by gravity.

14. The mill of claim 13, further comprising:

a plurality of fasteners, wherein the flights extend between the rings with the outer surface of each flight being held against the rings by the fasteners, at least first fasteners extending from a flight into a ring, such that the first fasteners and rings are shielded from the cleansing media by the flights.

15. The mill of claim 14, further comprising:

at least one media hopper;

at least one media thrower;

a media conveyor for conveying media from the spent media chamber to the media hopper;

a feed conveyor in communication with the media hopper and the media thrower for feeding media from the hopper to the thrower; and at least one magnetic control valve in communication with the thrower for regulating media input thereto.

16. The mill of claim 15, further comprising:

an entrance vestibule juxtaposed with the entrance ring;

an exit vestibule juxtaposed with the exit ring, wherein the curtains are respectively suspended in the entrance and exit vestibules, and wherein at least one of the vestibules can be distanced from the housing to permit a person to enter the blast housing.

* * * * *